US007762649B2

(12) United States Patent
Mukai et al.

(10) Patent No.: US 7,762,649 B2
(45) Date of Patent: Jul. 27, 2010

(54) PRINTING HEAD, INK JET PRINTING APPARATUS, AND INK JET PRINTING METHOD EJECTING MAIN AND SUB-DROPLETS

(75) Inventors: Kayo Mukai, Tokyo (JP); Hiromitsu Hirabayashi, Kanagawa (JP); Satoshi Nawa, Kanagawa (JP)

(73) Assignee: Canon Finetech Inc., Misato-shi (JP)

( * ) Notice: Subject to any disclaimer, the term of this patent is extended or adjusted under 35 U.S.C. 154(b) by 359 days.

(21) Appl. No.: 11/691,145

(22) Filed: Mar. 26, 2007

(65) Prior Publication Data

US 2007/0247493 A1 Oct. 25, 2007

(30) Foreign Application Priority Data

Apr. 19, 2006 (JP) ..... 2006-116101

(51) Int. Cl.
*B41J 2/135* (2006.01)

(52) U.S. Cl. ..... 347/44; 347/56

(58) Field of Classification Search ..... 347/20, 347/44, 46, 47, 56, 61–65, 67
See application file for complete search history.

(56) References Cited

U.S. PATENT DOCUMENTS 5,148,192 A * 9/1992 Izumida et al. ..... 347/44

FOREIGN PATENT DOCUMENTS

| | | |
|---|---|---|
| EP | 0 661 158 A2 | 7/1995 |
| EP | 1 020 288 A2 | 7/2000 |
| EP | 1 197 335 A1 | 4/2002 |
| JP | 60-262660 | 12/1985 |
| JP | 2000-263788 | 9/2000 |
| JP | 2000-334971 | 12/2000 |
| JP | 2002-292862 | 10/2002 |

OTHER PUBLICATIONS

Office Action in Chinese Patent Application No. 200710096617.8 dated Dec. 26, 2008, and English translation thereof.

* cited by examiner

*Primary Examiner*—Juanita D Stephens
(74) *Attorney, Agent, or Firm*—Fitzpatrick, Cella, Harper & Scinto

(57) ABSTRACT

A printing head, an ink jet printing apparatus, and an ink jet printing method can achieve high-speed printing while realizing a high-quality image. An ejection port face where an ejection port of the printing head is located is formed so that the normal line thereof intersects with an axis line of a nozzle at a predetermined angle. The ejection port face inclines in a relative moving direction of the printing head with a printing medium as a reference.

24 Claims, 12 Drawing Sheets

PRINTING HEAD, INK JET PRINTING APPARATUS, AND INK JET PRINTING METHOD EJECTING MAIN AND SUB-DROPLETS

BACKGROUND OF THE INVENTION

1. Field of the Invention

The present invention relates to a printing head capable of ejecting a liquid such as an ink, an ink jet printing apparatus that prints an image using the printing head, and an ink jet printing method.

2. Description of the Related Art

In an ink jet printing apparatus, a printing head is used which is capable of ejecting a liquid such as an ink by using an electro-thermal converter (heater) or a piezo-element. As shown in FIG. 9A, in a printing head H using an electro-thermal converter 101, a liquid in a flow path 102 is foamed by heat of the electro-thermal converter 101 (see FIGS. 9B and 9C), and by utilizing the foam energy of air bubbles B generated at this time, the liquid can be ejected from an ejection port 103. The air bubbles B defoam as shown in FIGS. 9D and 9E. To the head H of the present example, a movable valve 104 is provided in the flow path 102 in order to effectively cause the foam energy of the air bubbles B to act in the direction of the ejection port 103. An ink jet printing apparatus using such a print head H is capable of printing an image on a printing medium by applying the liquid ejected from the ejection port 103. In the printing apparatus, demand for higher speed printing has been increased.

For such a printing head H, a new problem has become apparent as the printing speed increases. As shown in FIG. 9D, when dividing a liquid column pushed out from the ejecting port 103 to form a droplet (main-droplet), a sub-droplet Ds referred to as a satellite is also formed along with main-droplet Dm as shown in FIG. 9E. When these main-droplet Dm and sub-droplet Ds have landed on the printing medium deviated from each other, the image quality of the printed image may deteriorate. As shown in FIG. 10A, the ejecting timing of the sub-droplet Ds is later than that of the main-droplet Dm, and the ejecting speed Vs of the sub-droplet D is lower than the ejecting speed Vm of the main-droplet Dm. Therefore, as the relative moving speed Vf of the head H and the printing medium W becomes higher, deviation d of the landing positions of the main-droplet Dm and the sub-droplet Ds becomes larger (see FIGS. 10B and 10C). FIGS. 10A, 10B, and 10C illustrate that the printing medium W moves against the head H. D1 is a dot formed on the printing medium W by a main-droplet Dm, and D2 is a dot formed on the printing medium W by a sub-droplet Ds.

Conventionally, in order to keep the deviation of the landing positions of the main-droplet and the sub-droplet small, a distance h (see FIG. 10A) between an ejection port face (face where the ejection port is located) of the printing head and the printing medium is narrowed, or the ejecting speed of a liquid is increased.

Meanwhile, Japanese Patent Laid-Open No. 2000-263788 describes a configuration for matching the ejecting directions of main-droplet and sub-droplet of ink. When a nozzle portion including an ejection port and a flow path is formed of a plurality of materials, a difference in surface energy among the materials, in other words, a difference in wettability to the ink, occurs. The configuration described in Japanese Patent Laid-Open No. 2000-263788 is provided focusing on the fact that the deviation in the ejecting directions of the main-droplet and the satellite occurs due to such difference in wettability to the ink. That is, the ejection port face is inclined so that the part of the flow path on the side where a material with less surface energy is located is made shorter than the part of the flow path on the side where a material with more surface energy is located. This causes the ejecting directions of the main-droplet and the satellite to be made coincident.

However, when attempting to shorten the distance h (see FIG. 10A) between the ejection port face of the head and the printing medium in order to keep the deviation of landing positions of the main-droplet and the sub-droplet small, there is a limit to shortening the distance h. When the distance h is too short, the printing medium may contact the ejection port face of the head as a result of cockling on the printing medium where a liquid is provided. In addition, poor liquid ejection may also occur as a result of a liquid bounced back from the surface of the printing medium or a liquid in mist form attaching to the ejection port face. When attempting to increase the ejecting speed of liquid in order to keep the deviation of landing positions of the main-droplet and the sub-droplet small, there also is a limit to speeding up.

Thus, keeping small the deviation of landing positions of the main-droplet and the sub-droplet while achieving higher printing speed is difficult just by shortening the distance h between the ejection port face of the head and the printing medium, or by speeding up the ejecting speed of liquid.

On the other hand, Japanese Patent Laid-Open No. 2000-263788 only discloses a configuration for matching the ejecting directions of the main-droplet and the sub-droplet as shown in FIG. 10A. With such a configuration, solving the problem associated with the increase in the printing speed as shown in FIGS. 10B and 10C, i.e., suppressing the increase in deviation of the landing positions of the main-droplet and the sub-droplet, cannot be achieved.

Conventionally, as described, the deviation of the landing positions of the main-droplet and the sub-droplet that increased along with the increase in printing speed could not be sufficiently suppressed. In particular, complying with a request desired for an ink jet printing apparatus for industrial use was difficult, i.e., a request for higher printing speed and higher quality of printed image. In an ink jet printing apparatus for industrial use, for example, when printing with barcodes, the deviation of landing positions of the main-droplet and the sub-droplet will be critical. Barcodes are printed information made of combinations of black bars and white spaces different in thickness. Thus, when the deviation of the landing positions of the main-droplet and the satellite increased, sizes or positions of the bars or spaces move out of readable standards, which may make the barcodes unable to be read.

FIGS. 11, 12A, and 12B are explanatory views of printing results in the case of landing positions of the main-droplet and the sub-droplet deviated in so-called serial scan type and full line type ink jet printing apparatuses.

In the so-called serial scan type ink jet printing apparatus, as shown in FIG. 11, an image is sequentially printed on the printing medium W by repeating an operation of ejecting a liquid while the head H moves in the main scanning direction of an arrow X and an operation of conveying the printing medium W in the sub-scanning direction of an arrow Y. The printing method in FIG. 11 is a bi-directional printing method that prints the image when the head H moves both in the forward direction of an arrow X1 and in the backward direction of an arrow X2. Upon the former forward scanning, a dot D2 is formed deviated from the center of a dot D1 in the traveling direction (X1 direction) of the head H. On the other hand, upon the latter backward scanning, the dot D2 is formed deviated from the center of the dot D1 in the traveling direction (X2 direction) of the head H. When the scanning speed (moving speed in the arrows X1 and X2 directions) of the head H is relatively low, the dot D2 is formed within the dot D1 as shown in FIG. 11. However, when the scanning speed becomes high, the dot D2 is formed outside the dot D1. As a result, when the barcodes are printed at high speed, the barcodes may be unable to be read.

In the so-called full line type ink jet printing apparatus, as shown in FIG. 12A, an image is continuously printed on the printing medium W by ejecting a liquid from the head H while continuously conveying the printing medium W in the arrow Y1 direction with the head H being fixed. The dot D2 is formed deviated from the center of the D1 in the direction opposite (arrow Y2 direction) the conveying direction (arrow Y1) of the printing medium W. The arrow Y2 direction is a relative moving direction of the head H against the printing medium W. When the conveying speed of the printing medium W is relatively low, the dot D2 is formed within the D1 as shown in FIG. 12A. However, when the conveying speed of the printing medium W is high, the dot D2 is formed outside the dot D1 as shown in FIG. 12B. As a result, when the barcodes are printed at high speed, the barcodes may be unable to be read.

SUMMARY OF THE INVENTION

The present invention provides a printing head, an ink jet printing apparatus, and an ink jet printing method that enable to print a high quality image while achieving high speed printing.

In the first aspect of the present invention, there is provided a printing head mounted at a location capable of moving relative to a printing medium and capable of printing an image on the printing medium by ejecting a liquid from an ejection port of a tip of a nozzle while moving relative to the printing medium, wherein an ejection port face, where the ejection port is located, has a normal line that intersects with an axis line of the nozzle at a predetermined angle so that the ejection port face inclines in a relative moving direction of the printing head with the printing medium as a reference.

In the second aspect of the present invention, there is provided an ink jet printing apparatus, comprising moving means that relatively moves the printing head, and the printing medium, and controlling means that ejects the liquid from the ejection port at the printing head while relatively moving the printing head and the printing medium.

In the third aspect of the present invention, there is provided an ink jet printing method that prints an image on a printing medium by using a printing head capable of ejecting a liquid from an ejection port of a tip of a nozzle to eject the liquid from the ejection port while relatively moving the printing head and the printing medium, wherein an ejection port face of the printing head, where the ejection port is located, is formed so that a normal line of the ejection port face intersects with an axis line of the nozzle at a predetermined angle, and wherein when printing the image on the printing medium, the printing head and the printing medium are relatively moved so as to incline the ejection port face in a relative moving direction of the printing head with the printing medium as a reference.

According to the present invention, a normal line of the ejection port face of the printing head where the ejection port is located is formed to intersect with an axis line of the nozzle at a predetermined angle, and the ejection port face inclines in the direction associated with the relative moving direction of the printing head and the printing medium. This allows proactive differentiation of the ejecting directions of main-droplet and sub-droplet of a liquid ejected from the ejection port. The main-droplet is formed by ejecting the liquid in the nozzle near the ejection port, and the sub-droplet is formed by ejecting the liquid in the nozzle away from the ejection port. As described, proactive differentiation of the ejecting directions of the main-droplet and the sub-droplet keeps the deviation of the landing positions of the main-droplet and the sub-droplet on the printing medium small, and a high quality image can be printed while achieving the high speed printing.

Further features of the present invention will become apparent from the following description of exemplary embodiments (with reference to the attached drawings).

Figure 1:
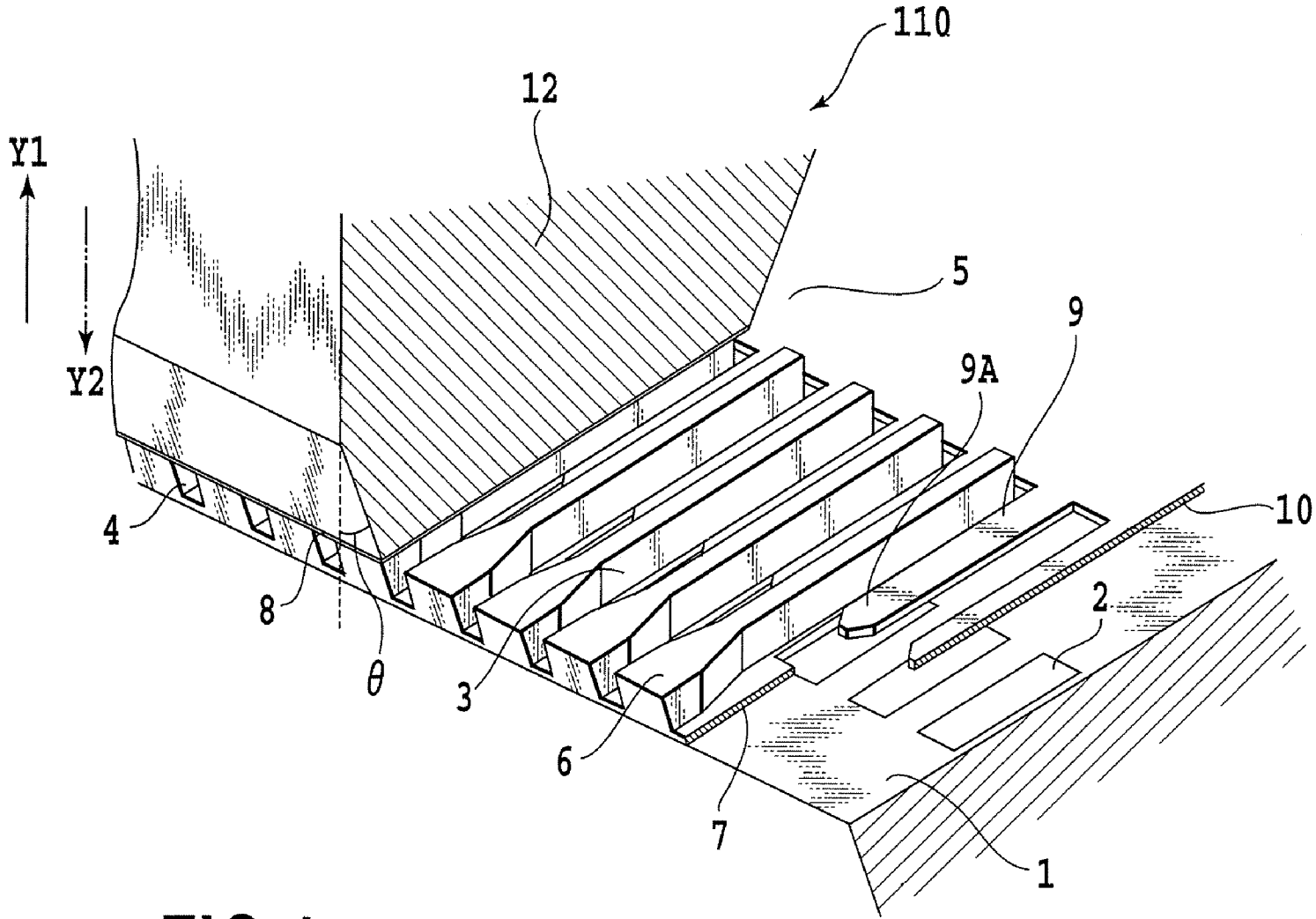
FIG. 1 is a partially cut-out perspective view of main parts of a printing head according to a first embodiment of the present invention.
Figure 3:
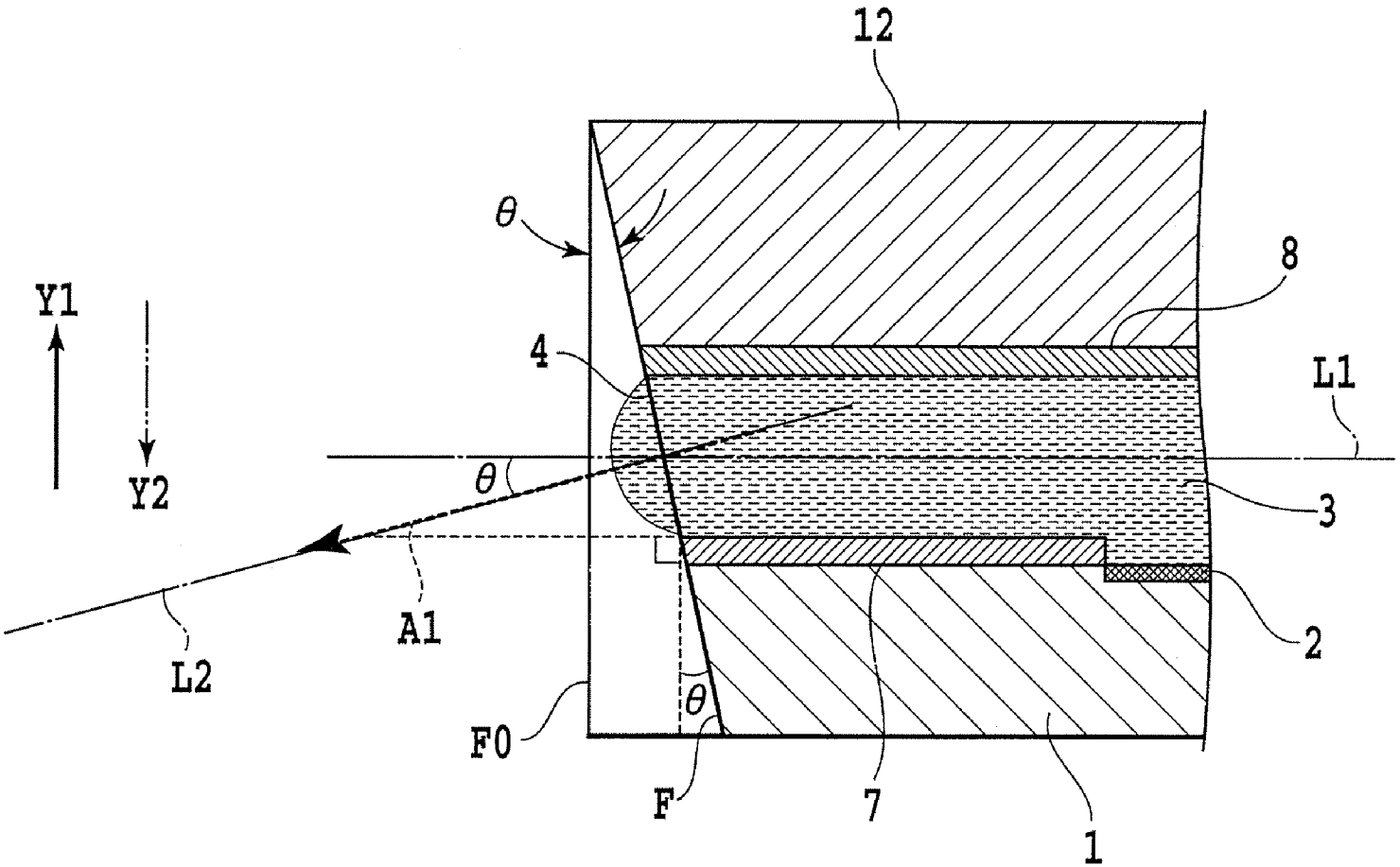
Figure 4:
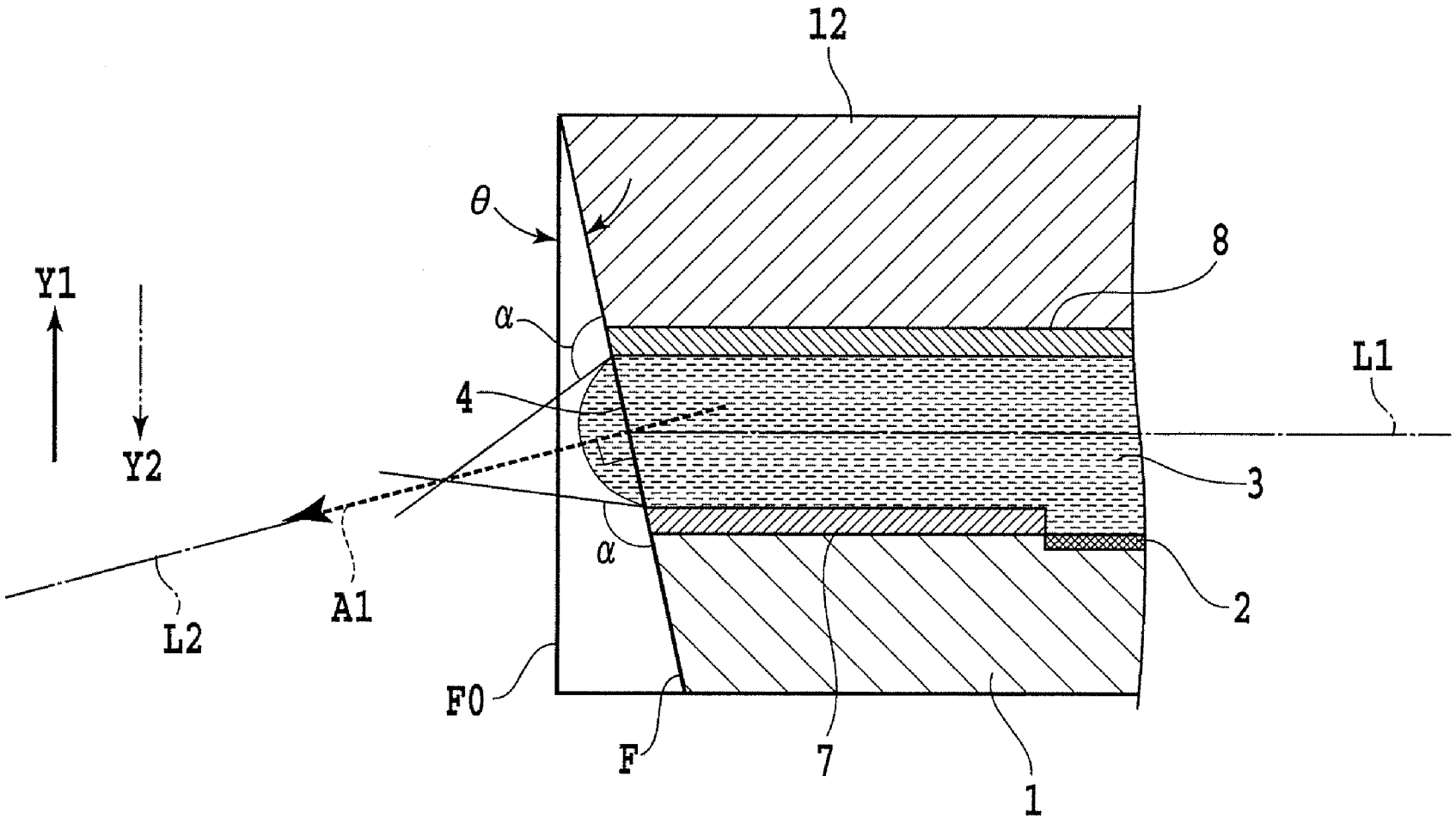
Figure 5C:
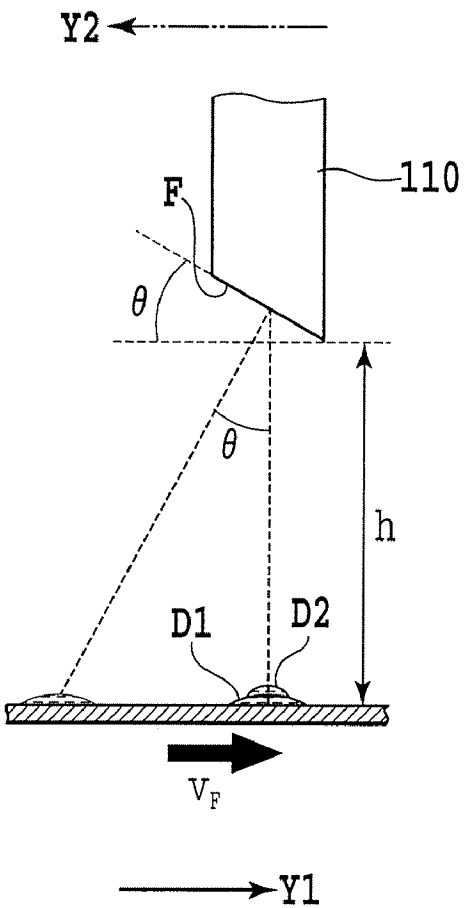
Figure 5B:
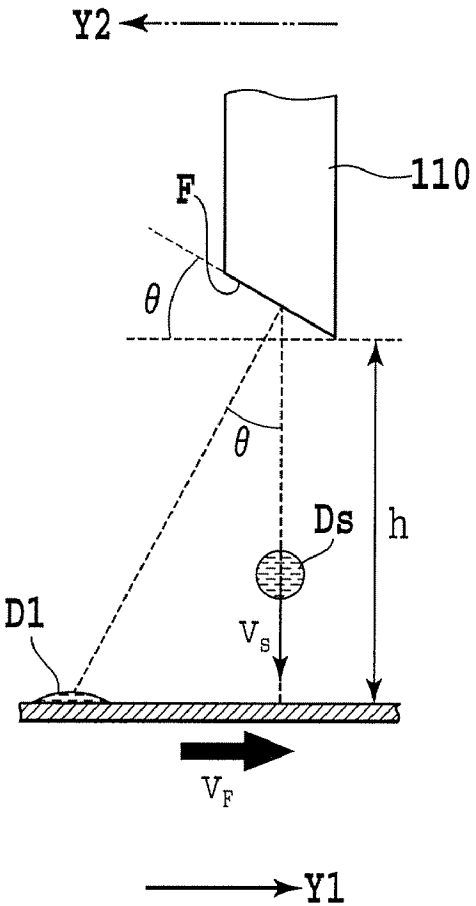
Figure 5A:
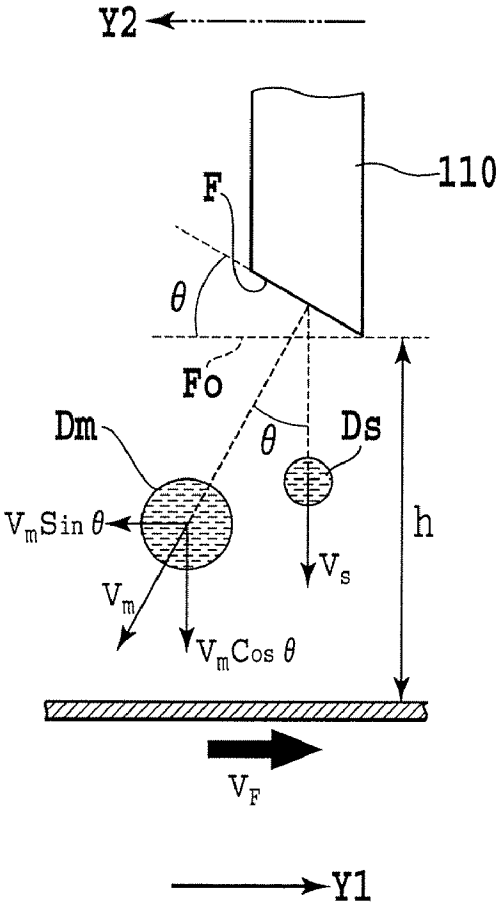
Figure 6:
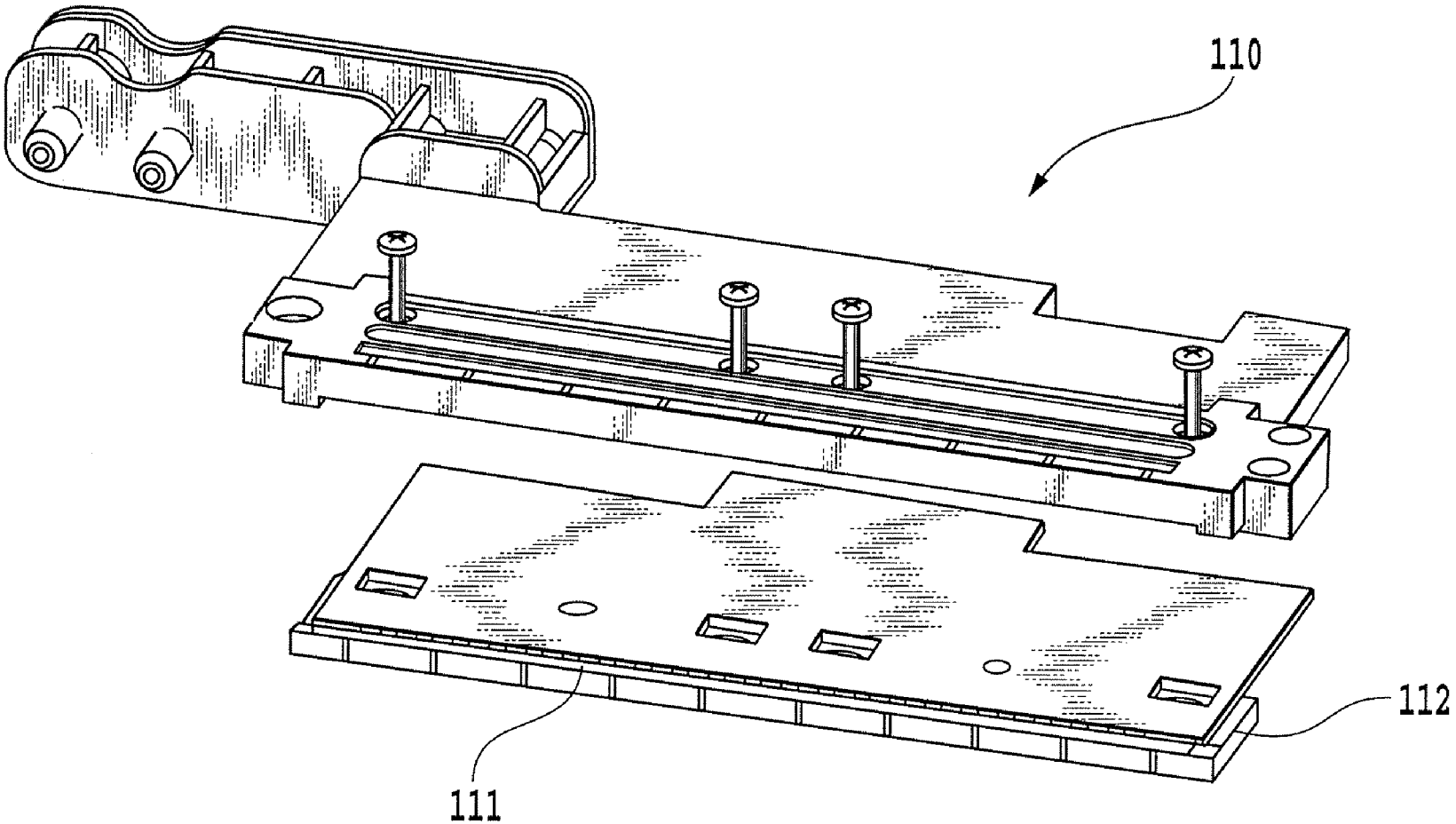
Figure 7:
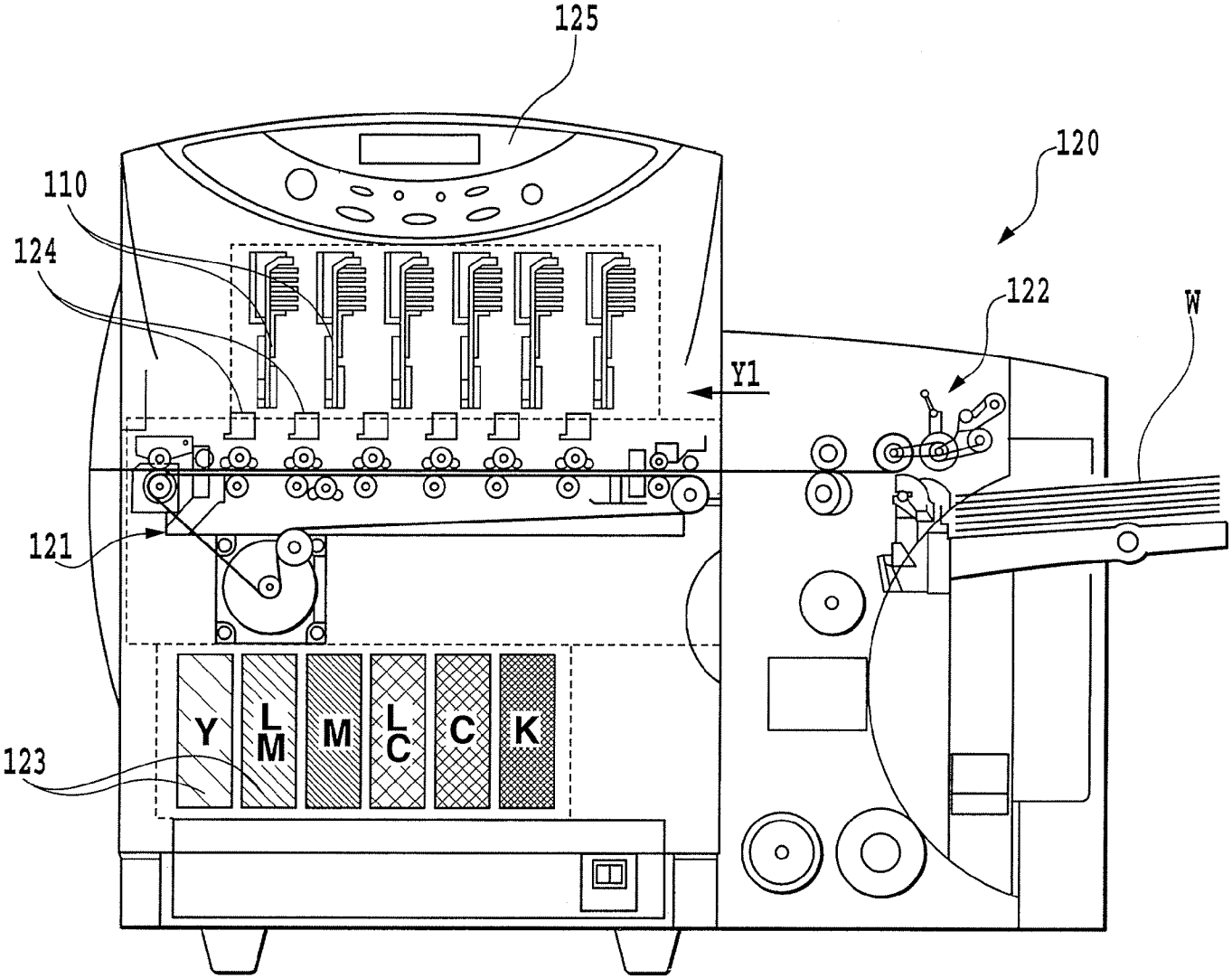
Figure 8A:
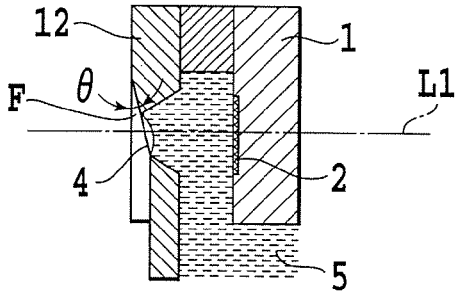
Figure 8B:
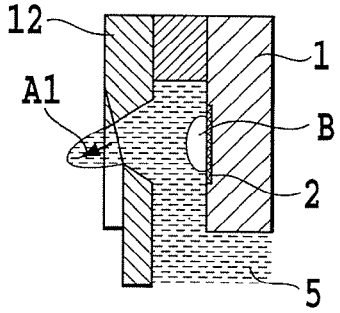
Figure 8C:
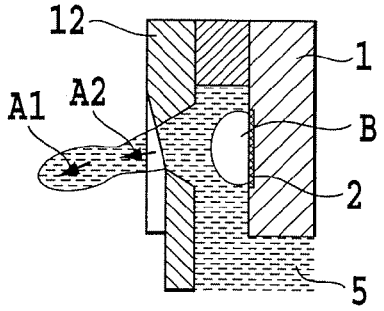
Figure 8D:
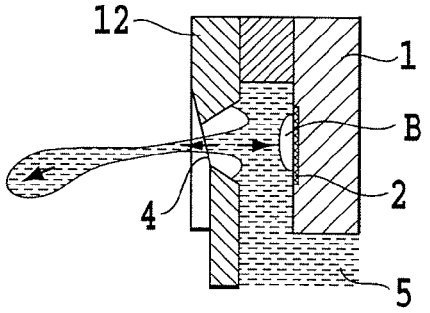
Figure 8E:
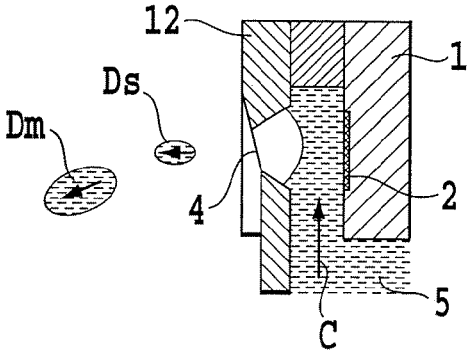
Figure 9A:
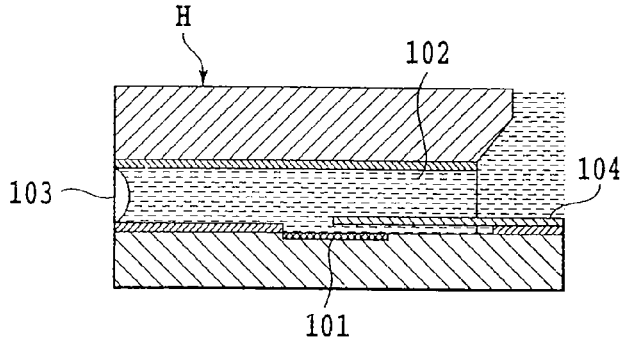
FIG. 9A PRIOR ART
Figure 9B:
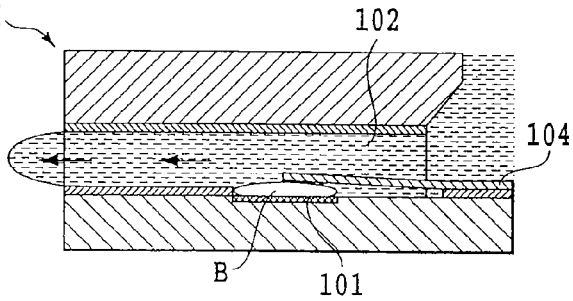
FIG. 9B PRIOR ART
Figure 9C:
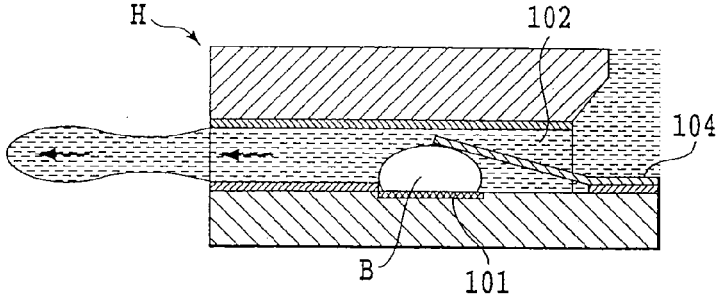
FIG. 9C PRIOR ART
Figure 9D:
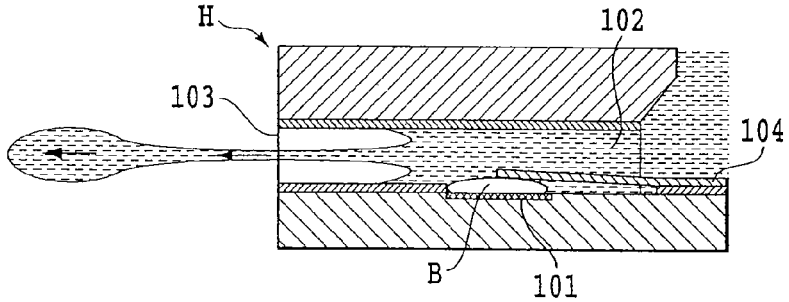
FIG. 9D PRIOR ART
Figure 9E:
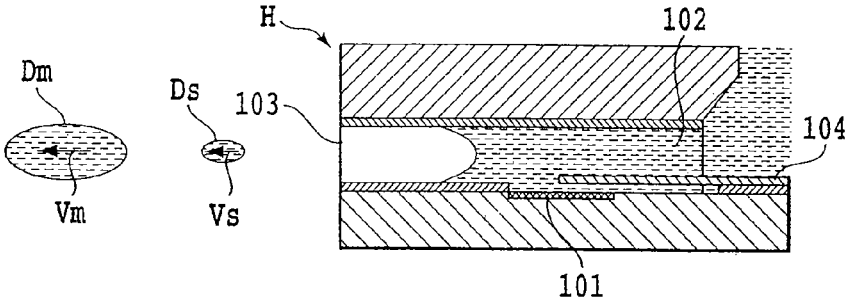
FIG. 9E PRIOR ART
Figure 10C:
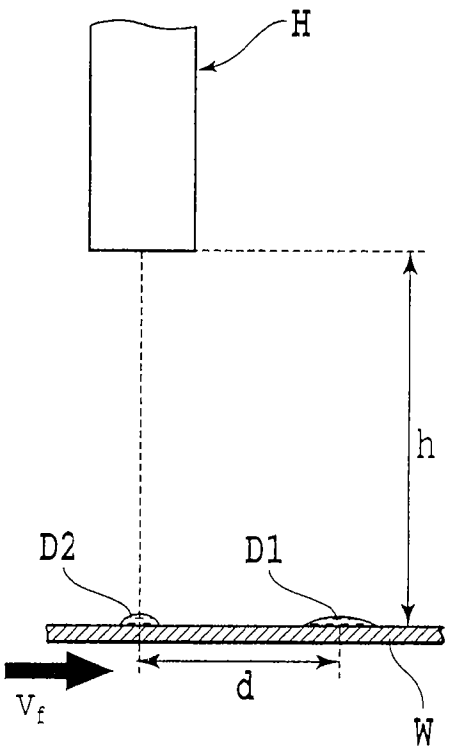
FIG. 10C PRIOR ART
Figure 10B:
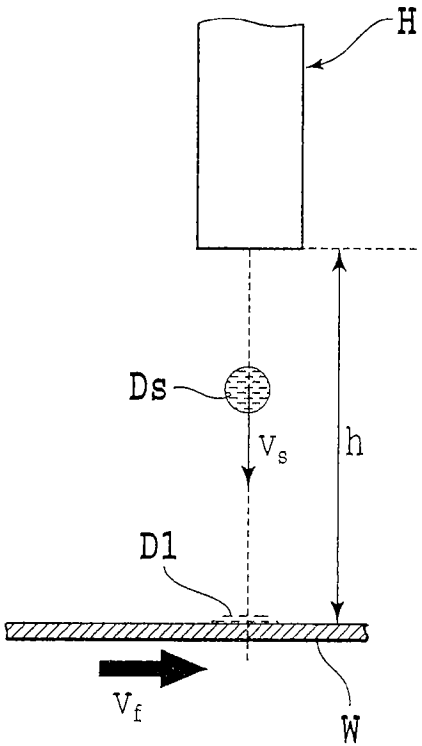
FIG. 10B PRIOR ART
Figure 10A:
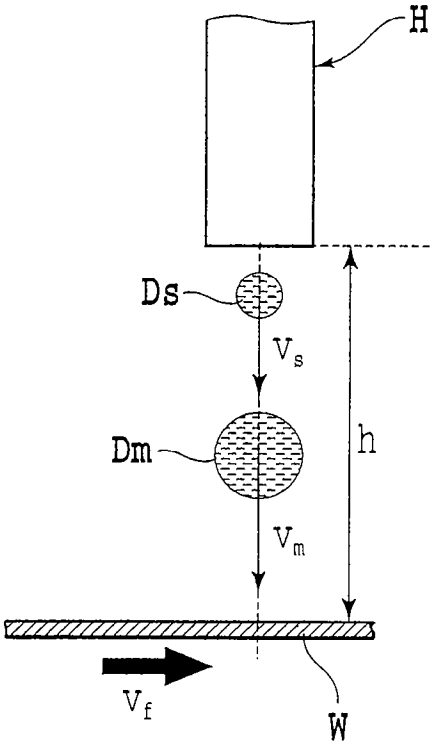
FIG. 10A PRIOR ART
Figure 11:
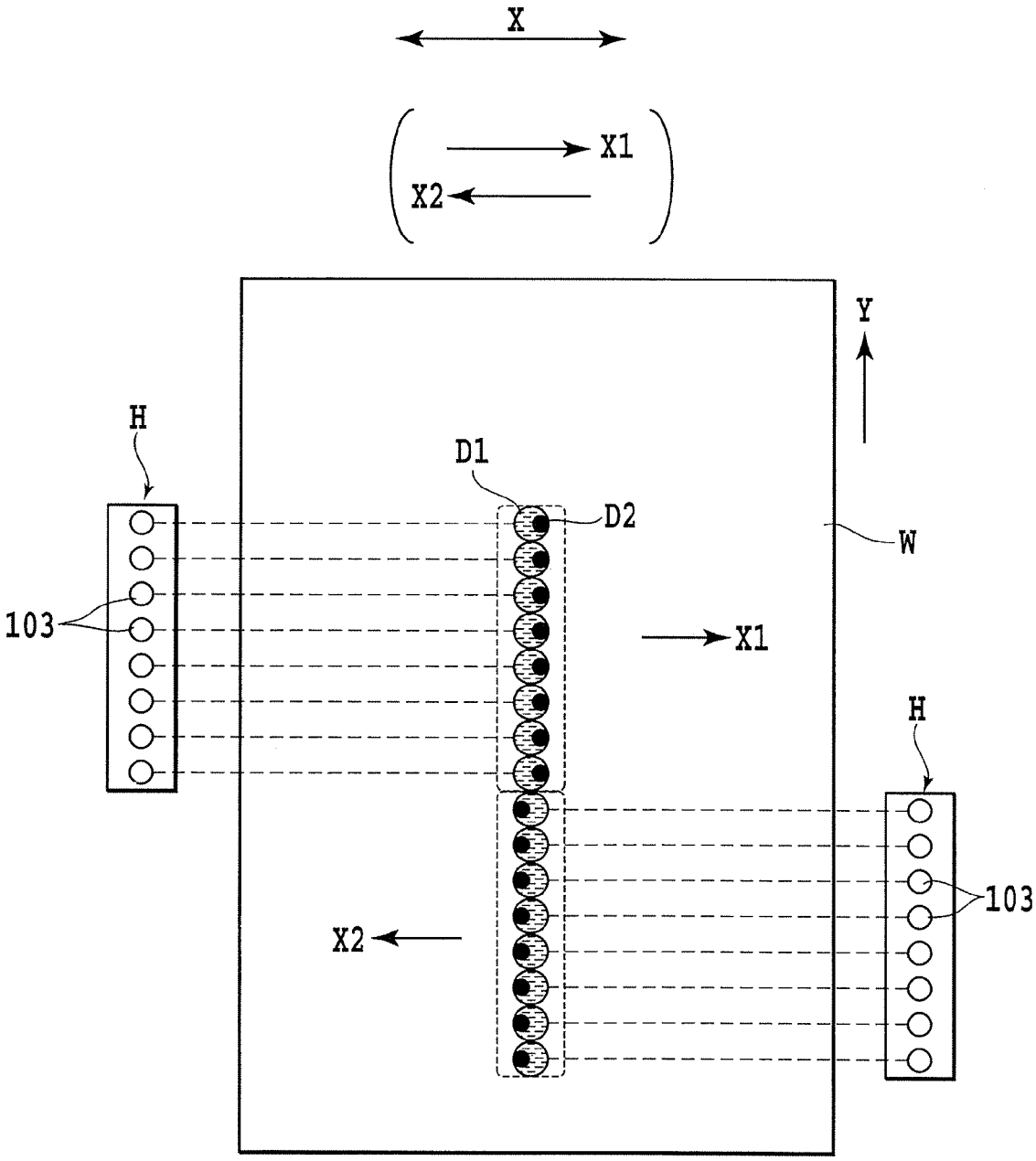
Figure 12A:
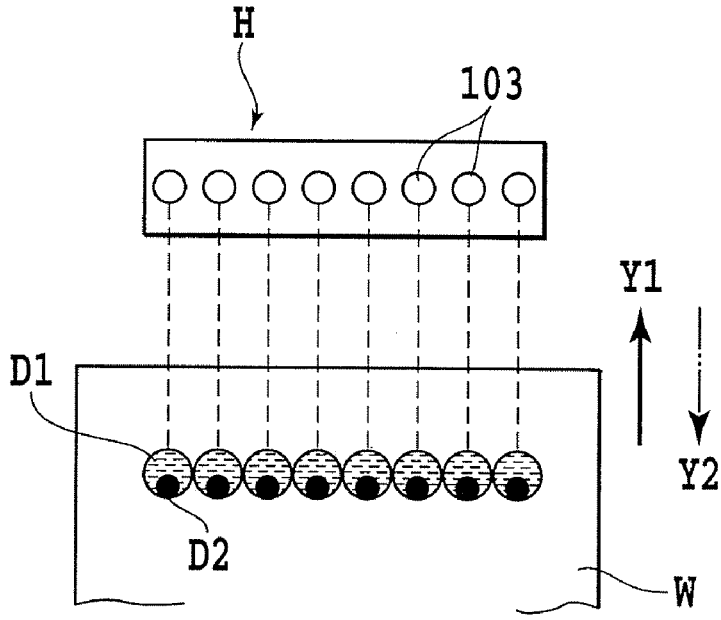
Figure 12B:
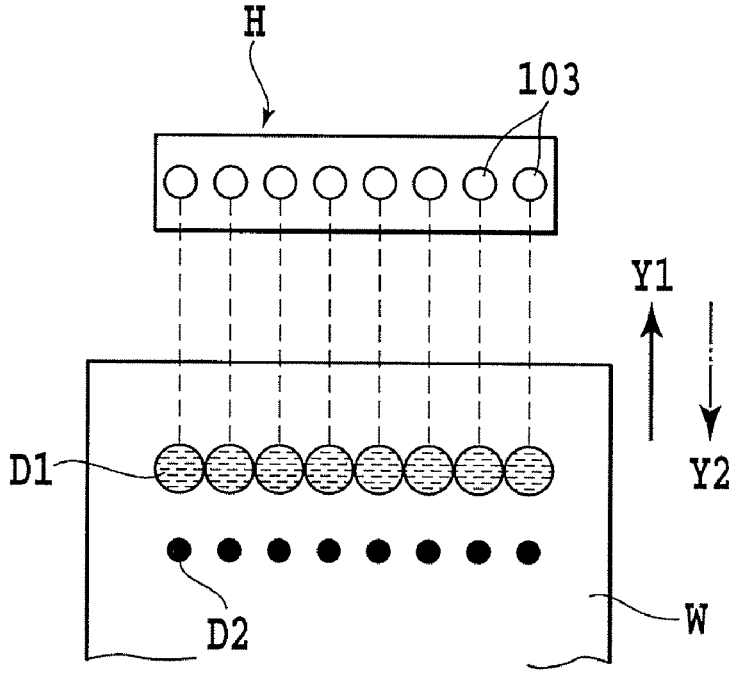

Each of FIGS. 2A, 2B, 2C, 2D, and 2E is an explanatory view of an ejecting process of a liquid at the printing head of FIG. 1;

FIG. 3 is an explanatory view of an inclination angle of an ejection port at the printing head of FIG. 1;

FIG. 4 is an explanatory view of an ejecting direction of the liquid at the printing head of FIG. 1;

Each of FIGS. 5A, 5B, and 5C is an explanatory view of landing positions of droplets ejected from the printing head of FIG. 1;

FIG. 6 is an exploded perspective view of the printing head of FIG. 1;

FIG. 7 is a schematic front view of an ink jet printing apparatus having the printing head of FIG. 1;

Each of FIGS. 8A, 8B, 8C, 8D, and 8E is an explanatory view of an ejecting process of a liquid at a printing head according to a second embodiment of the present invention;

Each of FIGS. 9A, 9B, 9C, 9D, and 9E is an explanatory view of an ejecting process of a liquid at a printing head of a conventional art;

Each of FIGS. 10A, 10B, and 10C is an explanatory view of landing positions of droplets ejected from the printing head of FIG. 9A;

FIG. 11 is an explanatory view of a printing example printed by a serial scan type ink jet printing apparatus using the printing head of FIG. 9A; and Each of FIGS. 12A and 12B is an explanatory view of a printing example printed by a full line type ink jet printing apparatus using the printing head of FIG. 9A.

DESCRIPTION OF THE EMBODIMENTS

The present invention will now be described based on the drawings.

First Embodiment

FIG. 6 is an exploded perspective view of a printing head according to a first embodiment of the present invention. The printing head of the present embodiment is used in an ink jet printing apparatus as a printing head 110 for ejecting a liquid ink. Reference numeral 111 denotes an ejecting element equipped with an electro-thermal converter (air bubble generating device), a common liquid chamber, a flow path, an ejection port, etc., as described below, and 112 denotes a ceramic plate arranged with an electric wiring board as described below. The common liquid chamber in the ejecting element 111 is connected to a plurality of flow paths provided inside of flow path forming members. An ink is supplied to an ink supply port of the flow path forming members from an ink tank (not shown). A plurality of nozzles are formed in alignment with flow paths, ejection ports, electro-thermal converters (air bubble generating devices), etc. The ink introduced into the common liquid chamber from the ink supply port is ejected from the ejection port of each nozzle.

FIG. 7 is a schematic front view of a full line type ink jet printing apparatus 120 capable of printing an image using the printing head 110. The printing apparatus 120 is provided with a conveying portion 121 that conveys a printing medium W such as paper in the conveying direction of an arrow Y1 and a feeding portion 122 that supplies the printing medium W to the conveying portion 121. Six printing heads 110 are removably mounted on the printing apparatus 120 of the present embodiment. Inks of yellow (Y), light magenta (LM), magenta (M), light cyan (LC), cyan (C), and black (K) from corresponding cartridges 123 are supplied to these printing heads 110. The six printing heads 110 are placed deviated in the conveying direction of the printing medium W. A nozzle alignment of each printing head 110 extends in an intersecting direction (perpendicular direction in the present embodiment) against the conveying direction of the printing medium W.

Reference numeral 124 denotes a recovering unit that conducts a recovering process to maintain a good ejecting state of the ink of the printing head 110. The recovering process may include, for example, a process for suction-ejecting or pressure-ejecting the ink that does not contribute to the printing of an image from the ejection port and a process for ejecting (preliminary-ejection) the ink that does not contribute to the printing of the image from the ejection port. The recovering process may further include a process for wiping an ejection port face (face where the ejection port is located) of the printing head 110. Reference numeral 125 denotes an operation panel portion for operating the printing apparatus 12.

FIG. 1 is a partially cut-out perspective view of a part near the nozzle of the printing head 110.

A plurality of heaters (electro-thermal converters) 2 for heating and foaming ink are placed on a heater board 1. Resistors such as tantalum nitride are used for the heaters 2 whose thickness, for example, is 0.01 to 0.5 μm, and whose sheet resistance value is 10 to 300Ω per unit square. Electrodes (not shown) of aluminum for conduction are connected to the heaters 2. On the one side of the electrodes, switching transistors (not shown) for controlling the conduction with the heaters 2 are connected. The switching transistors are drive controlled by an IC composed of circuits of gate devices for controlling, etc., and control the heaters 2 in accordance with signals from the printing apparatus.

The heaters 2 are formed at each of a plurality of flow paths 3. One end of each flow path 3 is communicated with a corresponding ejection port 4, and the other end of each flow path 3 is communicated with a common liquid chamber 5. The flow path 3 is surrounded by a heater board 1, nozzle walls 6, nozzle bank 7 of about 5-10 μm in thickness, and a nozzle top plate 8 of about 2 μm in thickness to form a tubular shape. In the present embodiment, the nozzle walls 6, the nozzle bank 7, and the nozzle top plate 8 are formed of photosensitive epoxy resin.

A movable valve 9 is provided in the flow path 3, and a free end 9A of the movable valve 9 is located near the ejection port 4, while the base end is located near the common liquid chamber 5. A supporting point at the base end of the movable valve 9 is attached to a valve supporting member 10, and the valve supporting member 10 is attached to the heater board 1 by a valve base 11 (see FIG. 2A). The nozzle top plate 8 is attached to a top plate 12 formed of Si, etc. At the top plate 12, an ink supply port (not shown) is formed by anisotropic etching, etc. A liquid ink is supplied into the common liquid chamber 5 from outside through the ink supply port, and the ink in the common liquid chamber 5 is supplied into each flow path 3.

An ejection port face F where the ejection ports 4 are located has a predetermined inclination of angle θ as follows.

As shown in FIG. 3, the ejection port face F is not perpendicular to the axis line (axis line of the nozzle) L1 of the flow path 3, but the normal line L2 of the ejection port face F and the axis line L1 incline at the angle θ. In other words, the ejection port face F is formed such that the normal line L2 intersects with the axis line L1 of the nozzle at the predetermined angle θ. The ejection port face F is inclined to face in the opposite direction (arrow Y2 direction) of the conveying direction Y1 of the printing medium W, i.e., to face in the relative moving direction of the printing head 110 with the printing medium W as a reference. Therefore, the ejection port face F is formed by inclining a face F0, which is perpendicular to the axis line L1, at the angle θ toward the relative moving direction (arrow Y2 direction) of the printing head 110. The size of the angle θ is established, as described below, taking into account the relative moving speed of the printing medium W and the printing head 10, etc.

FIGS. 2A to 2E are explanatory views of the ejecting process of droplets of the ink from the ejection port 4.

Figure 2A:
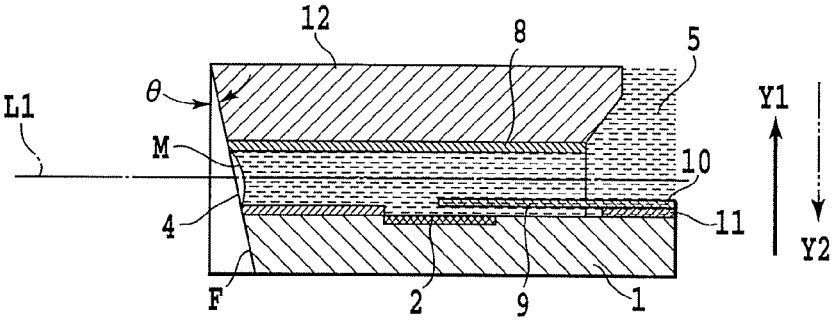

FIG. 2A illustrates a state before the ink in the flow path 3 is heated, i.e., a state of the heater 2 not energized. The ink near the ejection port 4 forms a meniscus M.

Figure 2B:
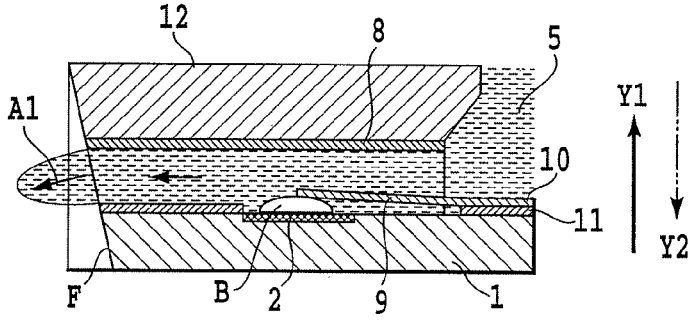
Figure 2C:
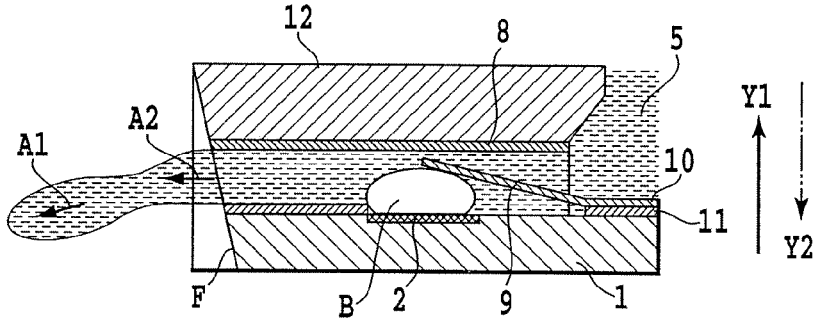

FIGS. 2B and 2C illustrate states of foam B generated with film boiling of ink, generated in the heated ink when the heater 2 is energized and heated. In this case, by the movable valve 9 shifting with the valve base 11 side as a supporting point, a propagation direction of the pressure based on the generation of the foam B is directed in the ejecting direction of the ink. The ink in the flow path 3 is ejected from ejection port 4 by the pressure generated by the foam and forms a liquid column such as the one shown in FIG. 2C as the foam B grows.

Figure 2D:
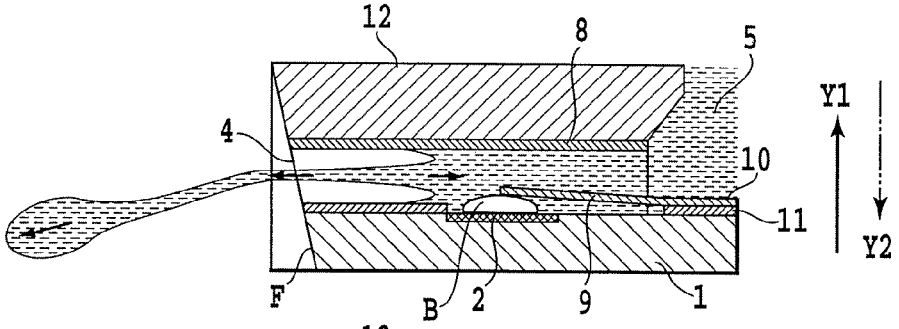
Figure 2E:
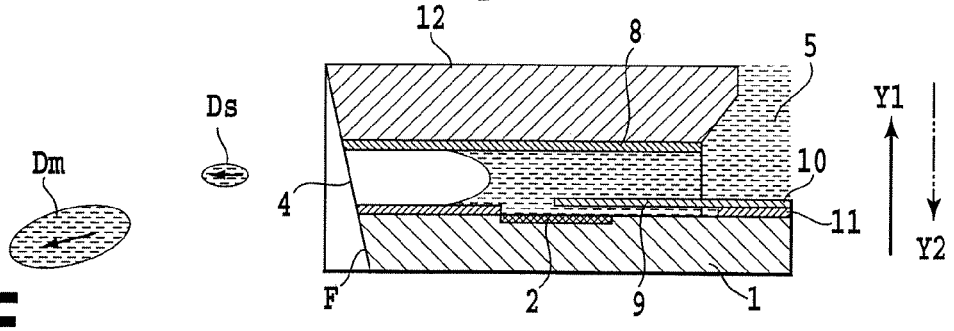

FIGS. 2D and 2E illustrate states of the foam B in the contraction process after the heating of the ink by the heater 2 has terminated. The ink near the ejection port 4 is drawn into the flow path 3 in accordance with the contraction of the foam B. Since the inertial force is acting in the ejecting direction at the tip portion of the liquid column, the liquid column is separated from the ink in the flow path 3. The separated liquid column forms main-droplet Dm and sub-droplet (satellite) Ds as a result of the surface tension of the ink and flies toward the printing medium.

The ejecting directions of such main-droplet Dm and sub-droplet Ds will be different as described below, since the ejection port face F is inclined at the predetermined angle θ.

As shown in FIGS. 2B and 2C, the meniscus M first starts to proceed in the ejection direction as the pressure generated by the foam propagates. This causes the ink near the ejection port 4 to be ejected from the ejection port 4 while maintaining the same contact angles α to the nozzle bank 7 and to the nozzle top plate 8 on the ejection port face F, as shown in FIG. 4. The angle defined by the ink ejection direction A1 and the axis line L1 of the flow path 3 will be the inclination angle θ of the ejection port face F as shown in FIG. 3. The ink near the ejection port 4 is ejected in the arrow A1 direction along the normal line L2 perpendicular to the ejection port face F, as shown in FIGS. 2B and 2C. The ink ejected in the arrow A1 direction will form the main-droplet Dm. On the other hand, as shown in FIGS. 2B and 2C, the ink located near the heater 2 is ejected in the arrow A2 direction along the axis line L1 direction of the flow path 3. The ink ejected in the arrow A2 direction will form the sub-droplet Ds.

As shown in FIG. 2D, the foam B enters into the contraction process, and the ink near the ejection port 4 is then drawn into the flow path 3 to form the main-droplet Dm and the sub-droplet Ds as shown in FIG. 2E. Since the directions of the main-droplet Dm and the sub-droplet Ds ejected by the foam are different, the main-droplet Dm flies in the arrow A1 direction (normal line L2 direction) at the angle θ with the axis line L1, and the sub-droplet Ds flies in the arrow A2 direction (axis line L1 direction), as shown in FIG. 2E.

The angle θ of the ejection port face F, i.e. the ejecting angle θ of the main-droplet Dm, is set in compliance with a configuration of the printing apparatus 120 having the printing head 110 or in compliance with control conditions. One example of a setting method of the angle θ will be described below based on FIGS. 5A, 5B, and 5C.

In this example, an ejecting speed of the main-droplet Dm is Vm, an ejecting speed of the sub-droplet Ds is Vs, a conveying speed of the printing medium W is Vf, and a distance between the ejection port 4 and the printing medium W is h. In a conventional printing head H in which an ejection port face is not inclined as shown in FIG. 10A, a deviation amount d in the landing positions of the main-droplet Dm and the sub-droplet Ds is shown by the following equation.

$$D=\{(1/Vs)-(1/Vm)\}\times h\times Vf$$

In this case, the deviation amount d is generated in accordance with the ejecting speeds of the ink Vm and Vs, distance h, and conveying speed Vf, and the landing positions of the main-droplet Dm and the sub-droplet Ds cannot be made coincident.

On the other hand, according to the printing head 110 of the present embodiment, the landing positions of the main-droplet Dm and the sub-droplet Ds can be made coincident by setting the angle θ so as to satisfy conditions of the equation below.

$$[(1/Vs)-\{1/(Vm\cdot\cos\theta)\}]\times h\times Vf=h\cdot\tan\theta$$

The equation above is rearranged to derive the equation below.

$$(1/Vs)-\{1/(Vm\cdot\cos\theta)\}=\tan\theta/Vf$$

High-quality image can be printed by setting the angle θ so as to satisfy the equation such as this to make coincident the landing positions of the main-droplet Dm and the sub-droplet Ds on the printing medium W.

Second Embodiment

The printing head 110 of the first embodiment described above is a so-called edge shooter type, and the ejecting direction of the ink and the supplying direction of the ink into the nozzle approximately coincide. However, the present invention can also be applied to a so-called side shooter type printing head. In the side shooter type printing head, the ejecting direction of the ink and the supplying direction of the ink into the nozzle are different.

FIGS. 8A to 8E are sectional views of main parts of the side shooter type printing head applying the present invention, and identical elements are designated with identical reference numerals in the above embodiment and will not be described.

The ejection port 4 is formed at a location of the top plate 12 facing the heater 2. The nozzle is formed by the heater 2, the flow path between the heater 2 and the ejection port 4, the ejection port 4, etc. The ejection port face F where the ejection port 5 is formed is inclined at the predetermined angle θ against the axis line L1 of the nozzle, as described in the above embodiment. The ink in the common liquid chamber 5 is supplied into the nozzle from the arrow C direction in FIG. 8E.

The printing head of the present example is capable of ejecting the ink utilizing the thermal energy of the heater 2, in the same way as the printing head in the above embodiment. As shown in FIGS. 8A to 8E, the ink in the nozzle is foamed by the heat of the heater 2, and the droplets of the ink can be ejected from the ejection port 4 by utilizing the foam energy of the air bubbles B at this time. Since the ejection port face F is inclined at the angel θ, the main-droplet Dm and the sub-droplet Ds ejected from the ejection port 4 are ejected in the same directions as stated in the above embodiment. In other words, the main-droplet Dm flies in the arrow A1 direction (normal line direction of the ejection port face) at the angle θ with the axis line L1, and the sub-droplet Ds flies in the arrow A2 direction (axis line L1 direction).

Thus, as in the embodiment above, high-quality image can be printed by making coincident the landing positions of the main-droplet Dm and the sub-droplet Ds on the printing medium W.

Other Embodiments

In addition to a printing head that ejects ink, the present invention can be applied to a printing head (liquid ejecting head) capable of ejecting various liquids used directly or indirectly for image printing. In addition, the ejecting method of the liquid of the printing head may be a method using an electro-thermal converter (heater), as well as a method using a piezo-element, etc. Furthermore, the movable valve 10 does not always have to be provided in an edge shooter type printing head such as the one described in the first embodiment.

The present invention can also be applied to the full line type ink jet printing apparatus shown in FIG. 7 as well as to the serial scan type ink jet printing apparatus described above. In either printing apparatus, as mentioned above, the ejection port only needs to be provided with a predetermined inclination angle in association with the relative moving direction of the head and the printing medium. In other words, the face (ejection port face F) on which the ejection port is formed only needs to be inclined such that the ejection port inclines and opens in the direction (arrow Y2) in which the head relatively moves against the printing medium. As a result, the axis line (L1) of the nozzle and the normal line (L2) of the ejection port face (F) where the ejection port is located are not coincident, but intersect at the predetermined angle instead.

In the foregoing embodiments, the nozzle walls 6, the nozzle bank 7, and the nozzle top plate 8 defining peripheral surfaces of the ejection port are made of the same material, and their physical characteristics are the same. However, among those peripheral surfaces, at least the nozzle top plate 8 in the arrow Y1 direction and the nozzle bank 7 in the arrow Y2 direction may be formed of the same material. Their physical characteristics may include at least one of wettability to liquid or surface roughness. In addition, as long as the physical characteristics are the same, the materials forming the peripheral parts of the ejection port may be different. Furthermore, an orifice plate in which an ejection port is formed may be attached to the aperture of the liquid flow path. Additionally, physical characteristics (including wettability to liquid) of the material forming the peripheral parts of the ejection port may be different, and in that case, the inclination angle of the ejection port only needs to be optimally set considering the difference in ejecting directions of the main-droplet and the sub-droplet resulting from the physical characteristics.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-116101, filed Apr. 19, 2006, which is hereby incorporated by reference herein in its entirety.

What is claimed is:

1. A printing head mounted at a location capable of moving relative to a printing medium and capable of printing an image on the printing medium by ejecting a liquid from an ejection port of a tip of a nozzle while moving relative to the printing medium, wherein the nozzle includes an electro-thermal converter that heats the liquid to generate a bubble, the nozzle being configured to eject the liquid from the ejection port by pressure generated by the bubble and to divide the liquid ejected from the ejection port into a main-droplet and a sub-droplet, wherein an ejection port face, where the ejection port is located, has a normal line that intersects with an axis line of the nozzle at a predetermined angle so that the ejection port face inclines in a relative moving direction of the printing head with the printing medium as a reference, wherein the main-droplet is formed by the liquid near the ejection port and is ejected along the normal line of the ejection port face, and wherein the sub-droplet is formed by the liquid at a location away from the ejection port and is ejected along the axis line of the nozzle.

2. The printing head as claimed in claim 1, wherein the ejecting direction of the main-droplet is inclined in compliance with the angle of the normal line of the ejection port face and the axis line of the nozzle so that a deviation of landing positions of the main-droplet and the sub-droplet on the printing medium becomes small.

3. The printing head as claimed in claim 1, wherein assuming Vm is an ejection speed of the main-droplet, Vs is an ejection speed of the sub-droplet, Vf is a relative moving speed of the printing head, and h is a distance from the nozzle to the printing medium, an inclination angle θ of the ejection port face satisfies the condition $$1/Vs-1/(Vm\cdot\cos\theta)=\tan\theta/Vf.$$

4. The printing head as claimed in claim 1, wherein among members forming peripheral surfaces of the ejection port, at least a member located in the relative moving direction of the printing head with the printing medium as a reference and a member located opposite the relative moving direction of the printing head with the printing medium as a reference are made of the same material.

5. The printing head as claimed in claim 1, wherein among the peripheral surfaces of the ejection port, at least a first surface located in the relative moving direction of the printing head with the printing medium as a reference and a second surface located opposite the relative moving direction of the printing head with the printing medium as a reference have equivalent physical characteristics.

6. The printing head as claimed in claim 5, wherein at least wettability to liquid and surface roughness of the first surface and the second surface are equivalent.

7. The printing head as claimed in claim 1, wherein the nozzle includes a movable plate that shifts in compliance with bubbling of the liquid generated by thermal energy of the electro-thermal converter.

8. An ink jet printing apparatus, comprising:

moving means that relatively moves the printing head of claim 1, and the printing medium; and controlling means that controls ejection of the liquid from the ejection port of the printing head while relatively moving the printing head and the printing medium.

9. The ink jet printing apparatus as claimed in claim 8, wherein the moving means includes a moving mechanism that moves the printing head in a main scanning direction and a conveying mechanism that conveys the printing medium in a sub-scanning direction intersecting with the main scanning direction.

10. The ink jet printing apparatus as claimed in claim 8, wherein a plurality of nozzles of the printing head are provided in alignment along a predetermined nozzle alignment direction, and wherein the moving means includes a conveying mechanism that conveys the printing medium in a direction intersecting with the nozzle alignment direction.

11. The printing head as claimed in claim 1, wherein among the peripheral surfaces of the ejection port, at least a first surface located in the relative moving direction of the printing head with the printing medium as a reference and a second surface located opposite the relative moving direction of the printing head with the printing medium as a reference have the same contact angle to the ink near the ejection port.

12. An ink jet printing method that prints an image on a printing medium, said method comprising the steps of:

providing a printing head capable of ejecting a liquid from an ejection port of a tip of a nozzle while relatively moving the printing head and the printing medium, wherein the nozzle includes an electro-thermal converter that heats the liquid to generate a bubble, the nozzle being configured to eject the liquid from the ejection port by pressure generated by the bubble and to divide the liquid ejected from the ejection port into a main-droplet and a sub-droplet, wherein an ejection port face of the printing head, where the ejection port is located, is formed so that a normal line of the ejection port face intersects with an axis line of the nozzle at a predetermined angle; and printing the image on the printing medium while effecting relative movement of the printing head and the printing medium with the ejection port face inclined in a relative moving direction of the printing head with the printing medium as a reference, wherein the main-droplet is formed by the liquid near the ejection port and is ejected along the normal line of the ejection port face, and wherein the sub-droplet is formed by the liquid at a location away from the ejection port and is ejected along the axis line of the nozzle.

13. An ink jet printing head capable of ejecting ink by using thermal energy, comprising:

a board providing a plurality of electro-thermal converters, each for heating ink to generate a bubble;

a top plate portion placed opposite the board to form a plurality of flow paths corresponding to the plurality of electro-thermal converters;

an ejection port face, in which a plurality of ejection ports corresponding to the plurality of flow paths are formed, and having a normal line that intersects with an axis line of one of the flow paths at a predetermined angle; and a board side wall portion placed on the board and positioned in an area between the plurality of electro-thermal converters and the plurality of ejection ports, wherein the board side wall portion and an inside wall member of the top plate portion are formed of the same resin material, the inside wall member forming the flow paths along with the board side wall portion, and wherein ink is ejected from each of the ejection ports and divided into a main-droplet and a sub-droplet in conjunction with growth and contraction of the bubble formed by heating by a corresponding one of the electro-thermal converters.

14. The ink jet printing head as claimed in claim 13, wherein the resin material is a photosensitive epoxy resin.

15. The ink jet printing head as claimed in claim 13, wherein the top plate portion has a top plate to which the inside wall member is attached.

16. The ink jet printing head as claimed in claim 15, wherein the resin material is a photosensitive epoxy resin.

17. The ink jet printing head as claimed in claim 13, wherein the main-droplet is ejected along the normal line of the ejection port face and the sub-droplet is ejected along the axis line of the one flow path.

18. The ink jet printing head as claimed claim 17, wherein the resin material is a photosensitive epoxy resin.

19. The ink jet printing head as claimed in claim 17, wherein the top plate portion has a top plate to which the inside wall member is attached.

20. The ink jet printing head as claimed in claim 19, wherein the resin material is a photosensitive epoxy resin.

21. The ink jet printing head as claimed in claim 19, wherein a material for forming the top plate is different from the material for forming the inside wall portion.

22. The ink jet printing head as claimed in claim 21, wherein the resin material is a photosensitive epoxy resin.

23. The ink jet printing head as claimed in claim 21, wherein the top plate is formed of Si.

24. The ink jet printing head as claimed in claim 23, wherein the resin material is a photosensitive epoxy resin.

* * * * *